US005612498A

United States Patent [19]

Wittig et al.

[11] Patent Number: 5,612,498

[45] Date of Patent: Mar. 18, 1997

[54] GROUND WATER SAMPLING DEVICE

[75] Inventors: Volker Wittig; Thomas M. Christy, both of Salina; Melvin P. Kejr, Brookville, all of Kans.

[73] Assignee: Kejr Engineering, Inc., Salina, Kans.

[21] Appl. No.: 582,278

[22] Filed: Jan. 3, 1996

Related U.S. Application Data

[62] Division of Ser. No. 430,340, Apr. 28, 1995.

[51] Int. Cl.[6] ..... E21B 49/08

[52] U.S. Cl. ..... 73/864.74

[58] Field of Search ..... 73/863.23, 864.73, 73/864.74, 864.34; 175/21, 58–60; 166/264

[56] References Cited

U.S. PATENT DOCUMENTS

| | | |
|---|---|---|
| 4,726,239 | 2/1988 | Boggess et al. . |
| 5,168,765 | 12/1992 | Broussard . |
| 5,176,219 | 1/1993 | Cole et al. . |

OTHER PUBLICATIONS

Pp. 5.1–5.12 of "Geoprobe Systems 1993–94 Equipment and Tools Catalog," and the ground water sampling tools depicted therein which were published, in public use or on sale in the U.S. prior to Apr. 28, 1994.

*Primary Examiner*—Robert Raevis
*Attorney, Agent, or Firm*—Shook, Hardy & Bacon L.L.P.

[57] ABSTRACT

A ground water sampling device includes an elongated cylindrical integral hollow housing with an inner surface defining an inner bore. The housing has an opening on its lower end and the upper end of the housing is adapted to be attached to a probe rod string. The bore has a primary diameter section and a reduced diameter section. The reduced diameter section is formed adjacent the lower end of the housing. The inner surface of the housing has a shoulder positioned at a location where the primary diameter section transitions to the reduced diameter section. An elongated hollow screen is telescopically received within the housing and is capable of being placed in a stowed position completely within the housing during driving of the device into the ground and in a deployed position where it extends out of the lower end of the housing to collect ground water. The screen has a ridge formed adjacent its upper end which engages the shoulder of the housing when the screen is in its deployed position to prevent further downward movement of the screen. An expendable drive point is positioned in the opening during driving of the device into the ground. The drive point is disengaged from the opening prior to the screen being deployed.

4 Claims, 1 Drawing Sheet

GROUND WATER SAMPLING DEVICE

Figure 1:
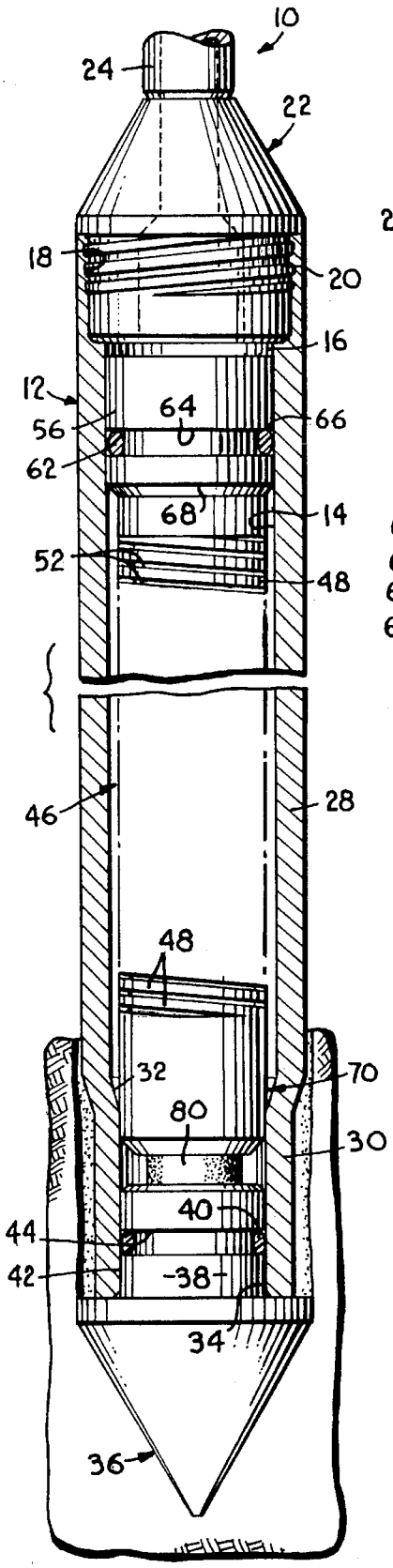

This is a divisional of copending application Ser. No. 08/430,340, filed on Apr. 28, 1995.

This invention relates to a device for obtaining water samples below the surface of the ground.

For many years, ground water samples have been taken for studying chemical dissipation and residue, for determining the concentration of environmental contaminants, for investigating hazardous waste sites, and for other uses well known in the art. Recently, sampling systems which utilize a percussion hammer have been used to drive sampling devices into the ground. One such sampling system utilizes a cylindrical hollow housing driven into the ground by a string of probe rods. During driving of the housing, a hollow screen is telescopically received in the interior of the housing and an expendable drive point is positioned on the lower end of the housing. This is the stowed or nondeployed position of the screen.

Once the desired sampling depth is reached, the probe rod string with the housing on its lower end is pulled upwardly a distance equal approximately to the length of the screen. This upward movement disengages the expendable drive point and leaves an open bore hole below the lower open end of the housing into which the screen can be deployed.

In order to deploy the screen through the lower open end of the housing, an extension rod string is positioned down the interior aligned bores of the probe rods until the lower end of the extension rod string engages the top of the screen. The extension rod string is then used to manually push the screen downwardly into the open bore hole. The downward movement of the screen stops when a ridge extending outwardly from the outer surface of the screen adjacent its upper end engages an inwardly extending shoulder positioned inside the housing adjacent its lower end. The shoulder is provided by threading a collar into the lower end of the housing. A male thread surface formed on the outer surface of the collar engages a female thread surface formed on the inner surface of the housing. The collar also typically will provide a seat for the expendable drive point.

Ground water can be sampled from the sampling device by any suitable means. For example, flexible tubing can be positioned down the interior of the probe rod string through the housing and into the screen. The end of the tubing extending out of the top of the probe rod string can then be hooked up to a peristaltic pump to collect the ground water sample.

The ground water sampling device described above is disadvantageous for a number of reasons. First, because female threads need to be formed in the housing in order to hold the collar in place adjacent the lower end of the housing, the thickness of the wall of the housing is reduced where the threads are formed. Because the housing is subjected to the percussive forces of the hydraulic hammer used to drive the housing into the ground, this area of reduced thickness is more prone to failure due to the stresses associated with the percussive forces. Further, the irregular sharp edges of the female thread surface create a concentration of stresses in the area of the thread surface when the percussive forces are applied, thus also increasing the possibility of failure at the thread surface.

Another disadvantage associated with the device is the difficulty and expense associated with manufacturing the housing with the female thread surface and the corresponding collar. The use of the collar is further disadvantageous because it creates an additional component to the device which must be assembled.

Another drawback of the sampling device involves the grouting of the open sample hole after a ground water sample has been taken. In order to grout the hole, the housing and the deployed screen must first be extracted from the hole utilizing the connected probe rod string. Thereafter, a separate string of probe rods is positioned back down the open hole and a grouting tube typically is positioned through the aligned bores of the probe rod string and out the bottom thereof. The hole is then grouted by dispensing grout out of the lower end of the probe rod string through the tube as the string is extracted from the ground. The hole may also be grouted by forcing or pouring grout directly into the aligned bores of the probe rod string without the use of a grouting tube. Thus, in order to effectively grout the hole, the labor intensive step of repositioning a probe rod string down the hole must be performed after the sampling device has been removed.

A still further disadvantage of the device involves damage to the screen, especially its lower end, as the device is driven into the ground. More specifically, as the percussive forces of the hammer are applied during driving, the screen telescopically received within the housing moves up and down with each percussive blow of the hammer. The lower end of the screen thus strikes the upper surface of the expendable drive point with each hammer blow. This repeated engagement between the screen and the point oftentimes causes damage or marring to the screen, especially at its lower end.

Therefore, a novel ground water sampling device construction is needed to alleviate the problems associated with prior ground water sampling devices.

Accordingly, it is a primary object of the present invention to provide a ground water sampling device which has a reduced number of components and which is more easily and relatively inexpensively manufactured.

A further important object of this invention is to provide a housing for the sampling device that has less sharp edges and a generally constant wall thickness so as to be more resistant to the stresses associated with the percussive driving forces the device is subject to.

Another object of this invention is to provide a screen for the sampling device in which the lower end of the screen can be opened so that grout can be dispensed out the bottom of the screen to fill the sample hole as the device is removed.

A further object of this invention is to provide a shock absorbing structure adjacent the lower end of the screen to prevent damage or marring to the screen caused by engagement with the upper surface of the drive point.

Figure 2:
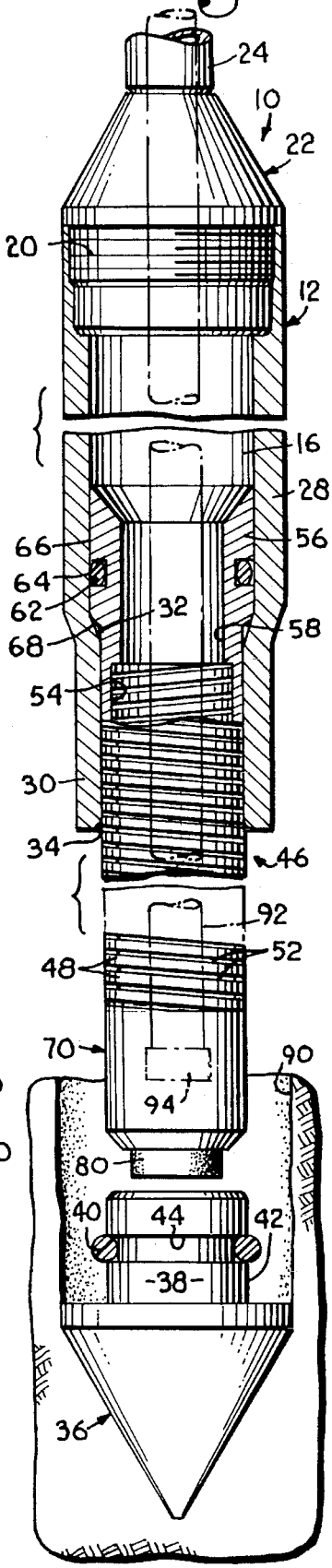
Figure 3:
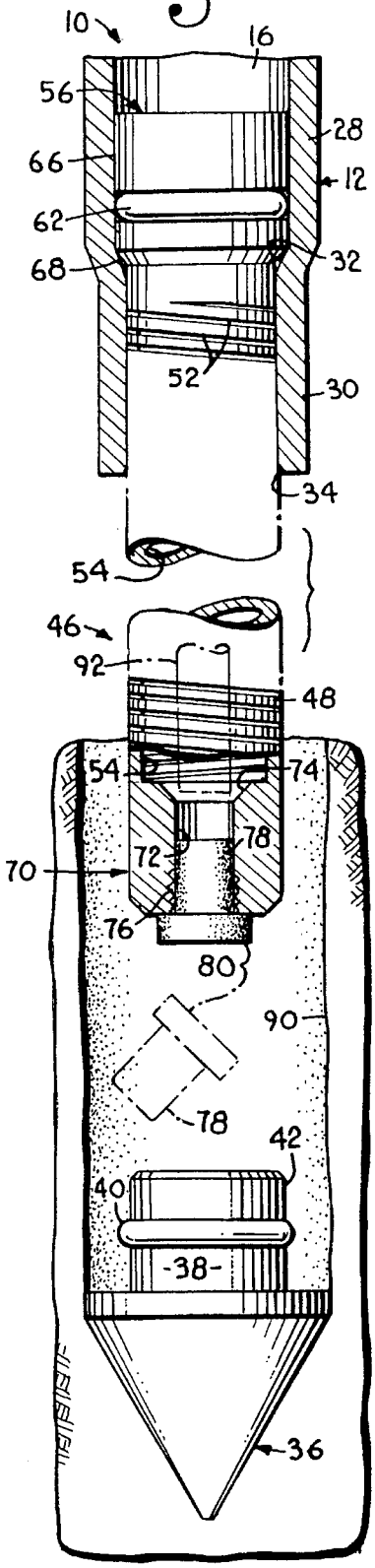

These and other important aims and objectives of the present invention will be further described, or will become apparent from the following description and explanation of the drawings, wherein:

FIG. 1 is a fragmentary, detailed cross-sectional view of a ground water sampling device embodying the principles of this invention and showing the screen assembly in its stowed position during driving of the device into the ground, parts being broken away and shown in cross section to reveal details of construction;

FIG. 2 is a fragmentary, detailed cross-sectional view of the device shown in FIG. 1 and showing the screen assembly in its deployed position with the ridge of the assembly engaging the shoulder of the housing, an extension rod string used to deploy the assembly shown in phantom lines, and parts being broken away and shown in cross section to reveal details of construction; and FIG. 3 is a view similar to FIG. 2 showing the device pulled upwardly a short distance so that the removable plug can be forced out of the bottom of the screen assembly, an extension rod string used to remove the plug and the disengaged plug shown in phantom lines.

A ground water sampling device embodying the principles of this invention is broadly designated in the drawings by the reference numeral 10. Device 10 includes a hollow cylindrical housing 12. Housing 12 has an inner surface 14 which forms an inner longitudinal bore 16. The upper end of housing 12 has a female thread surface 18 for engaging a male thread surface 20 of a drive head 22.

Drive head 22 is used to attach housing 12 to the lower end of a probe rod string (not shown). Drive head 22 has connecting section 24 which in turn has a male thread surface (not shown) for engaging the female thread surface of an adjacent probe rod section.

Bore 16 has a section 28 which has a substantially constant diameter and which is the primary inner diameter of housing 12. Housing 12 also has a section 30 wherein the diameter of the bore is reduced from the primary diameter. As inner surface 14 transitions from the primary diameter section 28 to the reduced diameter section 30, a downwardly and inwardly sloping shoulder 32 is formed. Shoulder 32 will serve as a stop for the screen assembly when it is deployed, as will be more fully described.

Opening 34 is formed at the lower end of housing 12 and at the lower end of reduced diameter section 30. An expendable drive point 36 is located on the lower end of housing 12. Drive point 36 has a solid cylindrical connecting portion 38 which is received through opening 34 and partially into reduced diameter section 30. A resilient O-ring 40 is positioned in an annular groove 44 formed on the outer surface 42 of portion 38. O-ring 40 serves to seal the interior of housing 12 from the surroundings during driving of the housing into the ground, as shown in FIG. 1.

Screen assembly 46 is telescopically received in bore 16 when the assembly is in its stowed position as shown in FIG. 1. Assembly 46 includes a hollow screen 48 which has a plurality of slits 52 which, when the screen is deployed, allow ground water to enter the interior 54 of the screen while at the same time preventing gravel or particles from entering the interior.

Screen 48 has a generally cylindrical end member 56 formed adjacent its upper end. Member 56 has a centrally disposed bore 58 in spatial communication with interior 54 of screen 48. An O-ring 62 is disposed in a groove 64 formed on an outer surface 66 of end member 56. Outer surface 66 also has an inwardly sloped annular ridge 68 formed adjacent to where the end member is attached to the screen. Ridge 68 engages shoulder 32 of the housing 12 when the screen is deployed, as will be more fully described.

The lower end of screen 48 has a generally cylindrical end member 70 connected thereto. End member 70 has a centrally disposed bore 72 which is in spatial communication with the interior of the screen through a chamfer section 74. The inner surface of bore 72 has a thread surface 76 formed thereon.

A resilient plug 78 is disposed in bore 72 to seal the lower end of screen 48. The resilient material out of which the plug is made engages thread surface 76 to secure the plug in bore 72. Although a thread surface 76 is described, any other type of gripping surface can be used to hold the plug in the bore. Plug 78 has a cap section 80 which extends below and partially over the lower surface of end member 70. Cap section 80 performs a shock-absorbing function for the screen assembly, as will be more fully described. Plug 78 is preferably made of a rubber material, however, any suitably resilient shock-absorbing material can be used.

With reference to FIG. 1, device 10 is shown with screen assembly 46 in its stowed position. In this position, housing 12 is driven into the ground utilizing a hydraulic percussion hammer (not shown) and a string of probe rod sections (not shown) in a manner that is well known in the art. During the driving of the device, percussive forces are transferred downwardly through the probe rod string through housing 12 and to drive point 36. Because of the percussive forces and the fact that screen assembly 46 has a certain amount of up and down "play" within bore 16, assembly 46 tends to move upwardly and downwardly with each percussive blow of the hammer. Cap 80 serves to cushion or absorb impact stresses that otherwise would be transmitted to the screen assembly from repeated engagement with the top of portion 38 of drive point 36. Further, cap 80 prevents marring or damage to end member 70 that could result from its contact with portion 38 during driving.

After the device has been driven to a desired depth below the ground surface, the screen is now ready to be deployed. In order to deploy the screen, the probe rod string with the housing attached thereto is pulled upwardly a distance approximately equal to the length of the screen assembly. This upward movement is accomplished by utilizing a pull cap on the upper end of the probe rod string in a manner that is well known in the art. This upward movement of housing 12 results in expendable drive point 36 being dislodged from opening 34. The screen assembly 46 is then deployed into the bore hole 90 previously occupied by housing 12. The screen assembly 46 is typically pushed out of housing 12 through opening 34 by extending a string of extension rods 92 (shown in phantom lines in FIG. 2) through the aligned bores of the probe rod string, through bore 16 of the housing and through the screen interior 54 to engage chamfer surface 74 of end member 70. The extension rod string has a contact member 94 attached to its lower end to engage surface 74 without entering bore 72 of member 70. Assembly 46 is forced downwardly by the extension rod string until ridge 68 of end member 56 engages shoulder 32. This engagement between ridge 68 and shoulder 32 serves to stop assembly 46 at its lowermost deployed position, as shown in FIG. 2. Extension rod string 92 used to deploy the screen assembly can then be removed from the screen, the housing, and the aligned bores of the probe rod string.

The device is now ready to be used to sample ground water. One typical way to obtain a ground water sample is to position flexible tubing down the interior of the probe rod string and into the interior of the screen. The end of the tubing extending out of the top of the probe rod string is then connected to a peristaltic pump to collect the water sample. Other devices, for instance, a bailer, can be used to collect water from the interior of the screen, as is well known in the art.

After the desired water samples have been taken, the device is extracted from the ground utilizing a pull cap attached to the upper end of the probe rod string in a manner that is well known in the art.

The construction of device 10 is advantageous if it is necessary to grout the open bore hole resulting from removal of the device and the probe rod string. More specifically, plug 78 can be forced out of bore 72 to allow positioning of a grouting tube downwardly through the aligned bores of the probe rod string, through housing 12, through the interior of screen 48, and out bore 72 so that the bore hole can be grouted as device 10 is removed. Additionally, grout can be poured or forced downwardly directly through the bores of the probe rod string, through the housing, through the screen, out of bore 72 and into the open bore hole without the use of tubing. Removable plug 78 thus eliminates the need to reposition a probe rod string down the open bore hole after the sampling device is removed in order to grout the bottom of the bore hole as was done in the past. Thus, an extra labor-intensive step can be avoided by utilizing the provision of removable plug 78.

Plug 78 is removed from bore 72 by positioning a string of extension rods 92 downwardly through the aligned bores of the probe rod string, through bore 16 of housing 12, and through the interior of screen 48 so that it engages the top of plug 78. In order to enter bore 72 to engage and remove plug 78, the lower end of string 92 does not have contact member 94 attached thereto, as shown in FIG. 3 in phantom lines. Chamfer surface 74 is used to align the lower end of the extension rod string with the top of the plug. Downward force applied to the extension rod string from the top of the hole will disengage the plug from the bore, thus opening the bottom of the screen to the bore hole. As is apparent, plug 78 is left at the bottom of the grouted bore hole as is expendable drive point 36.

Screen 48 and its end members 56 and 70 are preferably made of a metal material, for example, stainless steel. Housing 12 and drive point 36 are also preferably made of a metal material, for instance, tool steel. Further, housing 12 is manufactured in an advantageous manner which is simpler and more cost-effective than prior constructions.

More specifically, housing 12 begins as a tube having a generally constant inner diameter that is approximately the inner diameter of primary diameter section 28. The female thread surface 18 is formed in a conventional manner at the upper end of the housing. The lower end of the housing is inserted in a crimping machine from the lower end of the housing to the desired longitudinal location of shoulder 32. The housing is then crimped utilizing the crimping machine to form the reduced diameter section 30. The crimping action reduces the outer and inner diameter of the housing at section 30. The type of crimping machine used to form section 30 is typically a hydraulic crimping machine, for example, hydraulic crimping machines identified by the Model Nos. PC707 or PC3000, manufactured by Mechanical Tool and Engineering Company of Rockford, Ill. These types of mechanical crimping machines typically are used to crimp the ends of hydraulic hoses.

After the end of the housing has been crimped, the inner and outer surfaces of section 30 are milled in a conventional manner to remove the marks left by the crimping machine and, further, to obtain the desired inner and outer diameters of section 30. Additionally, shoulder 32 and the exterior surface of the housing radially outward therefrom may be milled to provide a smooth transition between section 28 and section 30. Thereafter, section 30 and a portion of section 28 adjacent shoulder 32 can be heat treated to further improve the strength of section 30 and shoulder 32.

This manufacturing method of making housing 12 allows a shoulder to be formed without the need for a separate collar that is threaded into the lower end of the housing. Further, because it is not necessary to form threads for a collar, the thickness of the wall of the housing is not unnecessarily reduced and the increased stresses caused by the sharp edges of formed threads are eliminated. More specifically, in driving systems wherein percussive loads are used, sharp edges, for instance those formed by threads, typically result in relatively large stress increases in the areas where they are formed. Therefore, it is desirous to have as smooth and unabrupt a surface as possible, which the advantageous manufacturing method of housing 12 provides. The manufacturing method of housing 12 further is advantageous because of its cost effectiveness. There is no need to form a separate collar or to form an additional set of female threads on the interior surface of the housing adjacent the lower end.

Having thus described the invention, what is claimed is:

1. A ground water sampling device adapted to be driven into the ground at the lower end of a probe rod string, comprising:

an elongated cylindrical integral hollow housing having an inner surface defining an inner bore and an opening on its lower end, an upper end of said housing adapted to be attached to a probe rod string;

an elongated hollow screen telescopically received within said housing and capable of being placed in a stowed position completely within said housing during driving of the device into the ground and a deployed position where it extends out the lower end of said housing to collect ground water, said screen having an aperture on its lower end and an unobstructed interior so that a string of extension rods can pass through said screen interior to said aperture;

a removable plug received in said screen aperture to seal said aperture, said plug capable of being forced downwardly out of said screen aperture by an extension rod string so that grout can be dispensed through said aperture to fill a sample hole as said housing and screen are removed; and an expendable drive point positioned in said opening of said housing during driving of said device into the ground, said drive point being disengaged from said opening prior to said screen being deployed.

2. The device of claim 1, wherein said removable plug is made of a resilient material.

3. The device of claim 2 wherein said screen has gripping means located adjacent said aperture for engaging said plug to aid the securement of said plug therein.

4. The device of claim 3 wherein said gripping means includes a thread surface.

* * * * *